US005766708A

United States Patent [19]

Panizza

[11] Patent Number: 5,766,708

[45] Date of Patent: Jun. 16, 1998

[54] SKI POLES FOR SKIERS MADE OF MATERIAL HAVING HIGH RESISTANCE AND INHERENTLY FRAGILE

[75] Inventor: Paolo Panizza, Vicenza, Italy

[73] Assignee: Gabel S.R.L., Tezze Sul Brento, Italy

[21] Appl. No.: 690,799

[22] Filed: Aug. 1, 1996

[51] Int. Cl.[6] ..... A63C 11/22

[52] U.S. Cl. ..... 428/36.1; 428/36.9; 428/36.91; 428/35.7; 280/819; 280/823

[58] Field of Search ..... 428/36.1, 36.2, 428/36.3, 36.91, 36.9; 280/819, 823; 138/106, 108, 109

[56] References Cited

U.S. PATENT DOCUMENTS

| | | | |
|---|---|---|---|
| 3,730,544 | 5/1973 | Hyman | 280/11.37 L |
| 3,974,012 | 8/1976 | Hogarth | 156/161 |
| 5,149,489 | 9/1992 | Crews | 362/32 |
| 5,397,636 | 3/1995 | Miyao et al. | 428/195 |

*Primary Examiner*—Rena Dye

*Attorney, Agent, or Firm*—Bucknam and Archer

[57] ABSTRACT

The ski pole is made of a material having high resistance and being inherently fragile and it is provided, corresponding to the interior or exterior part with at least one structure which extends substantially along the entire length of the ski pole, the structure being made of material resistant to traction, ductile and having good resiliency. In particular this structure may be made of a string (2) which is held in tension between ends (3) and (4) of the ski pole.

5 Claims, 2 Drawing Sheets

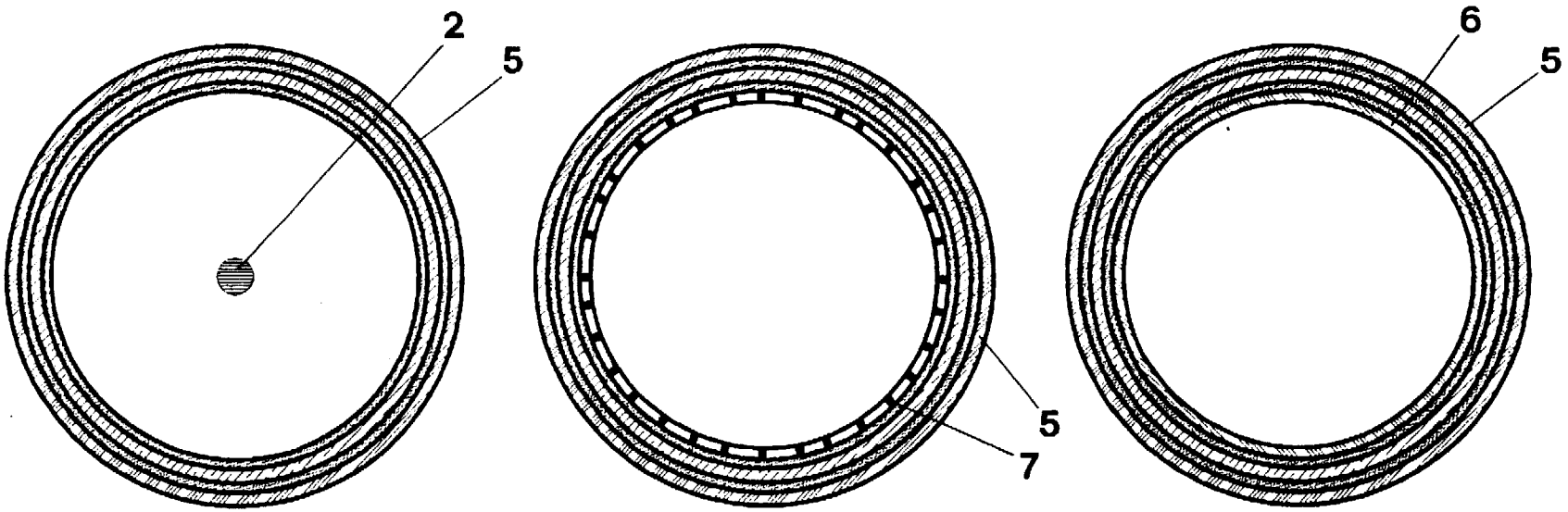
FIG. 4
FIG. 5
FIG. 6
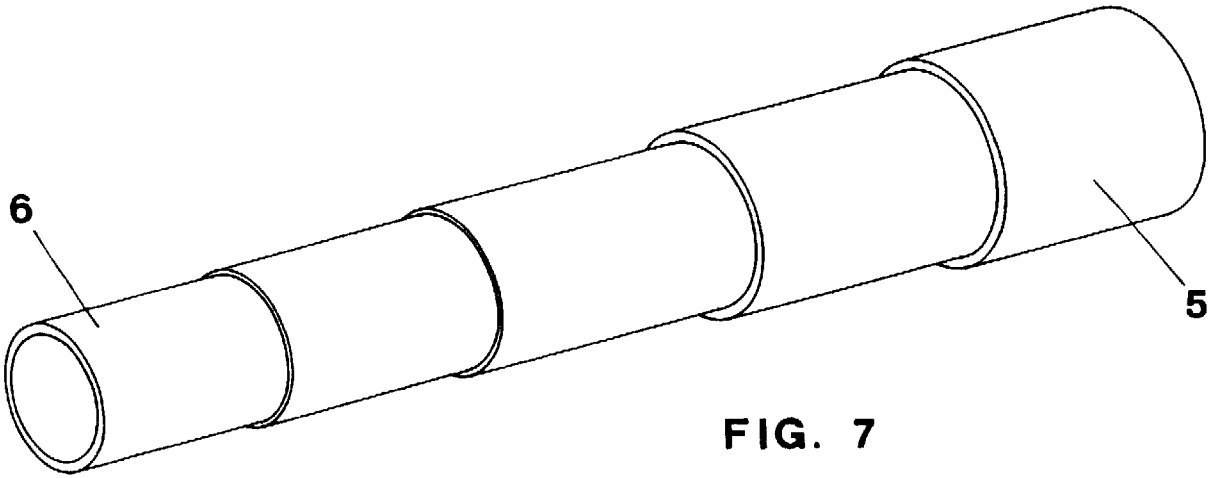
FIG. 7

SKI POLES FOR SKIERS MADE OF MATERIAL HAVING HIGH RESISTANCE AND INHERENTLY FRAGILE

FIELD OF THE INVENTION

The present invention relates to the poles used by skiers which are made of materials having high resistance and are inherently fragile.

BACKGROUND OF THE PRIOR ART

The ski poles in ski sport practice have been made for a long time of aluminum alloys which guarantee to the user and the manufacturer a good compromise with respect to cost, performance and workability. Still today these materials are used to an extent greater than other materials, but lately some ski poles have appeared in the market made with alternative materials, that is, composites made of a polymeric matrix based mainly on glass fibers (GF), carbon fibers (CF) and Kevlar (KF). The common object of these materials, in addition to commercial reasons, is the effort to increase the rigidity of the ski pole and simultaneously decrease the weight and the diameter. However, all these materials are fragile and this means that the finished articles may break. In actual practice, a sudden crushing, frequently of the "explosive" type, occurs which frequently shows some sections of complete fracture and several small and sharp fragments. In addition, the pieces in which the ski poles are divided have cutting ends and are rich in fragments of free fibers. The net result is that in the case in which there is a fracture of the ski poles, some consequences are possible which are potentially very dangerous both for the individual who was using the ski pole as well as other people who may be involved in the same accident.

In particular, the law ISO 7331.7.7.3 deals with the explosion in the point and is properly particularly severe in this respect.

For the purpose of eliminating the drawbacks mentioned hereinabove, the possibility exists of using ski poles made of drastically different material such as composites of a metallic matrix with still substantial residual ductility. The specific rigidity, however, is substantially lower with respect to the composites made of a polymeric matrix. Actually, there are some composites of metallic materials which are sufficiently rigid but they have insufficient ductility so that essentially the problem mentioned hereinabove remains and the danger due to the formation of small splinters still exists. In any event, all these materials made of a metallic matrix are very expensive.

SUMMARY OF THE INVENTION

An object of the present invention is to provide a ski pole made of material having high resistance and inherently fragile, which is simultaneously free of all the drawbacks mentioned hereinabove and at the same time, is light in weight essentially as the known ski poles and still has the same size as the known ski poles with respect to bulkiness and production costs.

This object is achieved according to the present invention by providing a structure which extends substantially along the entire length of the ski pole and which is made of material which is resistant to traction, ductile and which has good resiliency. In particular, it is possible to provide in the interior of the ski pole, a string of suitable material.

Further, it is possible to provide a plurality of structures in the form of thin layers and substantially coaxial to the global cress section of the tube, these structures being constituted either by thin tubes or a plurality of yarns which are reciprocally interlaced or are not interlaced.

These and other features of the invention will be described hereinbelow in detail by reference to the accompanying drawings of which.

FIGS. 4, 5 and 6 illustrate a transversal cross section of the device of the invention according to three particular embodiments;

FIG. 7 is an exploded view of the device of FIG. 6.

Figure 1:
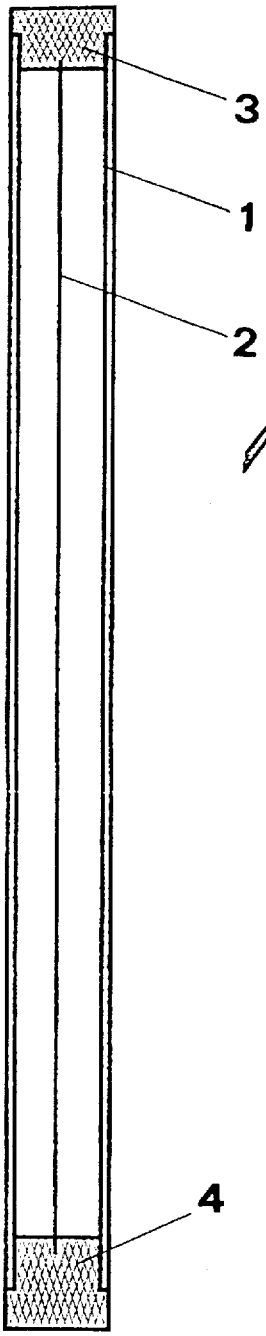
FIG. 1 is a longitudinal cross section of the device of the present invention according to a first embodiment.
Figure 2:
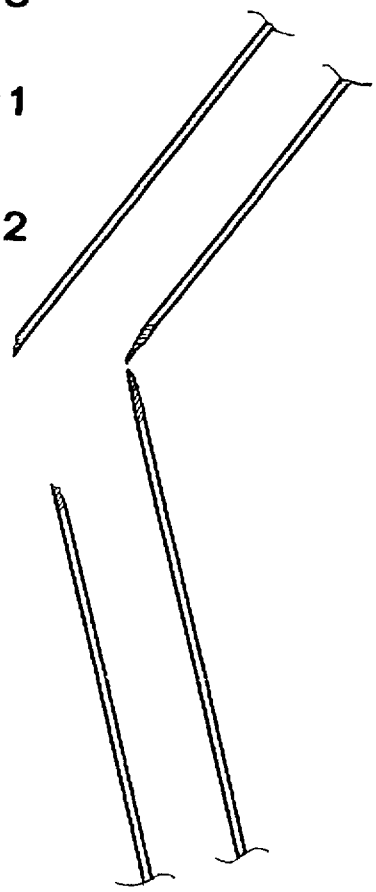
FIGS. 2 and 3 illustrate respectively a schematic view of the device and a longitudinal cross section of the device during the fracture phase.
Figure 3:
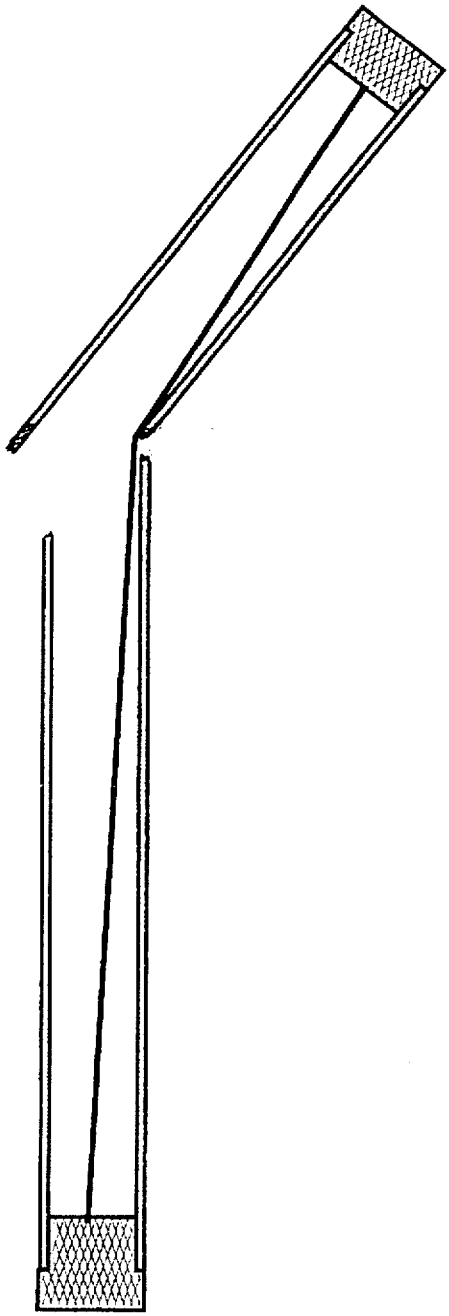

As already mentioned hereinabove, a substantial danger exists in the case of accidents deriving from the separation of two or more pieces which the ski pole made of composite material may form when it breaks. Therefore, when a string (2) is placed in the interior of the ski pole (1), the string being made of suitable material and moderately under tension between the ends 3 and 4 of the same ski pole, the string as shown in FIGS. 2 and 3 in the case of rupture of the ski pole, maintains the pieces together. The string actually is not under great tension because it is placed against the central axis of the ski pole. Actually, in case of great flexure, the tension tends to decrease.

When the ski pole breaks, therefore, it is sufficient if the string resists to the eventual tearing due to the elastic energy which is set free as well as the incision of the cutting borders of the pieces formed when the ski pole breaks.

The device mentioned hereinabove may be used by itself so as to guarantee in this manner a protection which will be referred to hereinbelow a primary protection against only the operation of the pieces with the minimum increase of the weight. The increase in weight may be about 5 to 6 grams for a ski pole of 130 centimeters including the anchoring of the ends of the string.

Alternatively it is possible to combine the string with a thin external layer (5) as it will be described in more detail hereinbelow, the function of which will be to guarantee secondary protection against the product and dispersion of the fragments. Naturally, this second solution is susceptible to determining a substantial increase in the total weight of the ski pole, that is about 20 to 25 grams for the weight of 130 centimeters of the ski pole.

Tests which have been carried out have permitted to verify the efficacy of the device described hereinabove.

The string may be made of a monoyarn or may be multiyarn and must be made of light material which is resistant and flexible and which is further provided with a certain amount of ductility and good resiliency such as for instance, Kevlar, (K) or nylon having high resistance, (NAR).

It has also been verified that the resistance to traction, including the anchoring of the string to the ends of the ski pole, is at least 490N while the pretensioning advantageously should not be superior to about 5% of the charge of fragmentation.

The invention is susceptible to being carried out according to other embodiments for instance, in the case in which a multiyarn string is made as shown in FIG. 5, it is sufficient to expand it radially up to the point where the component yarns (7) rest on the internal surface of the ski pole. The same applies to the string when it is monoyarn and in this case it is sufficient to use a thin tube (6) which is expanded up to the point of touching the internal tube of the ski pole as shown in FIG. 6.

In actual practice, it is necessary to add a suitable internal layer to the structure of the ski pole, a stocking in the first case and a full tube in the second case.

From an operational point of view, there are no particular problems as far as the process of manufacture of the device described hereinabove.

In the case in which a stocking is used, the crux of the matter resides in adopting yarns of sufficient consistency and connected in the matrix to the other layers so that they break the matrix and collapse toward the interior of the tube in a configuration similar to the string shown in FIG. 3 when the device breaks.

On the contrary, in the case in which a thin tube is used, in addition to a weak coupling with the other layers, a high plasticity of the materials is required in addition to an adequate resistance to traction.

From the operational point of view, the structures which are resistant discussed hereinabove may be made of Kevlor, Nylon, polyamides having a high resistance or a light alloy, polyethylene or similar material.

What is claimed is:

1. A ski pole for skiing made of a single piece (1), having an interior and made of a material having high resistance and inherently fragile which is provided with at least one first structure (2), said structure extending substantially along the entire length of the ski pole, said structure having at least 490N resistance to traction, said structure being ductile and having good resiliency, said structure which extends substantially along the entire length of the ski pole is placed in said interior of said ski pole, wherein said ski pole has two ends (3) and (4) and said first structure is constituted by a string (2), said string being held in tension between said ends (3) and (4) of said ski pole.

2. The ski pole according to claim 1, wherein said ski pole has an exterior and a second structure (5) extends along the entire length of said ski pole and is placed in said exterior of the ski pole.

3. The ski pole according to claim 2, wherein said ski pole has a cross section, said second structure is in the form of thin layers, said layers being substantially coaxial to said cross section of said ski pole.

4. The ski pole according to claim 3, wherein said layers are constituted by thin tubes (6).

5. The ski pole according to claim 1, wherein said string is monoyarn or multiyarn.

* * * * *